US006563264B2

(12) United States Patent
Niigaki et al.

(10) Patent No.: US 6,563,264 B2
(45) Date of Patent: May 13, 2003

(54) PHOTOCATHODE AND ELECTRON TUBE

(75) Inventors: Minoru Niigaki, Hamamatsu (JP); Toru Hirohata, Hamamatsu (JP); Tomoko Mochizuki, Hamamatsu (JP); Hirofumi Kan, Hamamatsu (JP)

(73) Assignee: Hamamatsu Photonics K.K., Shizouka (JP)

( * ) Notice: Subject to any disclaimer, the term of this patent is extended or adjusted under 35 U.S.C. 154(b) by 97 days.

(21) Appl. No.: 09/842,831

(22) Filed: Apr. 27, 2001

(65) Prior Publication Data

US 2002/0011787 A1 Jan. 31, 2002

Related U.S. Application Data

(60) Provisional application No. 60/220,654, filed on Jul. 25, 2000.

(51) Int. Cl.[7] ..... H01J 40/18

(52) U.S. Cl. ..... 313/527; 313/525; 313/542; 313/523; 313/544; 257/10

(58) Field of Search ..... 313/523, 542, 313/541, 525, 527, 544, 540, 530; 250/492.24; 257/10, 11

(56) References Cited

U.S. PATENT DOCUMENTS

| | | | | | |
|---|---|---|---|---|---|
| 3,958,143 | A | | 5/1976 | Bell | 313/94 |
| 4,015,284 | A | * | 3/1977 | Hara et al. | 257/10 |
| 5,518,934 | A | * | 5/1996 | Forrest et al. | 117/56 |
| 5,710,435 | A | * | 1/1998 | Niigaki et al. | 257/10 |
| 5,723,871 | A | * | 3/1998 | Nakanishi et al. | 250/423 R |
| 5,753,933 | A | * | 5/1998 | Morimoto | 257/14 |
| 6,121,612 | A | * | 9/2000 | Sinor et al. | 250/214 VT |
| 6,229,152 | B1 | * | 5/2001 | Dries et al. | 257/17 |
| 6,300,557 | B1 | * | 10/2001 | Wanlass | 136/244 |

FOREIGN PATENT DOCUMENTS

| | | |
|---|---|---|
| JP | 4-269419 | 9/1992 |
| JP | 5-234501 | 9/1993 |
| JP | 8-255580 | 10/1996 |

OTHER PUBLICATIONS

P.E. Gregory et al., "Field–assisted photoemission to 2.1 microns from a Ag/p–$In_{0.77}Ga_{0.23}As$ photocathode," Appl. Phys. Lett. 36(8), Apr. 15, 1980, pp. 639–640.

* cited by examiner

*Primary Examiner*—Ashok Patel
*Assistant Examiner*—Glenn Zimmerman
(74) *Attorney, Agent, or Firm*—Morgan, Lewis & Bockius LLP

(57) ABSTRACT

This photocathode comprises: InP substrate 1; $InAs_{x2}P_{1-x2}$ ($0<x2<1$) buffer layer 2; $In_{x1}Ga_{1-x1}As$ ($1>x1>0.53$) light-absorbing layer 3; $InAs_{x3}P_{1-x3}$ ($0<x3<1$) electron-emitting layer 4; $InAs_{x3}P_{1-x3}$ contact layer 5 formed on the electron-emitting layer 4; active layer 8 of an alkali metal or its oxide or fluoride formed on the exposed surface of electron-emitting layer 4; and electrodes 6 and 7.

4 Claims, 12 Drawing Sheets

Ga COMPOSITION
0
0.3
0.5
1.0
In COMPOSITION
1.0
0.7
0.5
0
5
4
3
2
1

P COMPOSITION
0
0.5
0.6
1.0
As COMPOSITION
1.0
0.5
0.4
0

PHOTOCATHODE AND ELECTRON TUBE

CROSS-REFERENCE TO RELATED APPLICATION

This application claims priority to Provisional Application Ser. No. 60/220,654 filed on Jul. 25, 2000, which is hereby incorporated by reference in its entirety.

BACKGROUND OF THE INVENTION

1. Field of the Invention

The present invention relates to a photocathode (photoelectron-emitting surface) for emitting a photoelectron in response to a photon incident thereon, and an electron tube using the same. In particular, it relates to a photocathode for detecting light in an infrared region, and an electron tube using the same.

2. Related Background Art

Concerning photocathodes which have a sensitivity in a long wavelength region among those absorbing incident light, exciting a photoelectron, and emitting it, there are techniques such as those described in U.S. Pat. No. 3,958,143 (hereinafter referred to as literature 1), Japanese Pat. Application Laid-Open No. H04-269419 (literature 2), P. E. Gregory, et al., "Field-assisted photoemission to 2.1 microns from a Ag/ρ-$In_{0.77}Ga_{0.23}As$ photocathode," *Appl. Phys. Lett.*, 36(8), Apr. 15, 1980, pp. 639–640 (literature 3), Japanese Patent Application Laid-Open No. H08-255580 (literature 4), and Japanese Patent Application Laid-Open No. H05-234501 (literature 5).

The technique disclosed in literature 1 is one concerning a transferred electron type photocathode, in which a light-absorbing layer and an electron-emitting layer are stacked on a semiconductor substrate, a bias voltage is applied to both layers, so as to form an electric field within the light-absorbing layer, and photoelectrons are accelerated by this electric field, so as to be emitted into vacuum.

The technique disclosed in literature 2 is a transition electron type photocathode of this kind, in which a Schottky electrode for applying the electrode is formed like a pattern by use of a photolithography technique, so as to enhance the reproducibility of electron emission with respect to incidence of light.

Literature 3 describes results obtained when photoelectron emission was observed with respect to incident light having a wavelength up to 2.1 μm while using $In_{0.77}Ga_{0.23}As$ as a light-absorbing layer in this kind of transition electron type photocathode.

The technique disclosed in literature 4 uses a p/n junction in place of the Schottky electrode, so as to stabilize the interface state, thereby improving reproducibility.

The technique disclosed in literature 5 uses a multiple quantum well layer as the light-absorbing layer, so as to absorb light among sub-bands, thereby enhancing sensitivity up to a long wavelength region.

SUMMARY OF THE INVENTION

However, even with these techniques, photocathodes having a favorable sensitivity in the infrared region, a region on the longer wavelength side from a wavelength of 1.7 μm in particular, have not come into practice.

Specifically, according to literature 3 concerned with results of an experiment to which the techniques disclosed in literatures 1, 2 are applied, the photoelectron conversion efficiency upon observation of photoelectron emission up to a wavelength of 2.1 μm was 0.1%, which was very low, whereas the results of observation were obtained while the photocathode was held at a extremely-low temperature of 125 K.

The technique of literature 4 is problematic in that it is hard to keep lattice matching at a wavelength of 1.7 μm or longer and acquire reproducibility.

The technique of literature 5 is disadvantageous in that the light absorption among sub-bands yields a lower absorption efficiency than the light absorption among conventional band to band, or inter bands does, thereby resultantly yielding a low photoelectric conversion efficiency.

Hence, a photocathode having a favorable sensitivity in the infrared region, a high photoelectric conversion efficiency, and a favorable reproducibility have not come into practice.

Therefore, in view of the above-mentioned problem, it is an object of the present invention to provide a photocathode having a favorable sensitivity in the infrared region, a high photoelectric conversion efficiency, and a favorable reproducibility; and an electron tube utilizing the same.

For solving the above-mentioned problem, the photocathode of the present invention is a photocathode for emitting a photoelectron in response to light in an infrared region incident thereon, and is characterized in that it comprises (1) a substrate comprising InP of a first conduction type; (2) a buffer layer, formed on the substrate, comprising $InAS_{x2}P_{1-x2}$ ($0<x2<1$) of the first conduction type lattice-matching the substrate; (3) a light-absorbing layer, formed on the buffer layer, comprising $In_{x1}Ga_{1-x1}As$ ($1>x1>0.53$) of the first conduction type lattice-matching the buffer layer; (4) an electron-emitting layer, formed on the light-absorbing layer, comprising $InAS_{x3}P_{1-x3}$ ($0<x3<1$) of the first conduction type lattice-matching the light-absorbing layer; (5) a contact layer, formed on the electron-emitting layer with a predetermined pattern so as to expose the electron-emitting layer with a substantially uniform distribution, comprising $InAs_{x3}P_{1-3}$ of a second conduction type; (6) an active layer, formed on the exposed surface of the electron-emitting layer, comprising an alkali metal or an oxide or fluoride thereof; (7) a first electrode formed on the contact layer; and (8) a second electrode formed in the substrate.

As a consequence, the light-absorbing layer absorbs light having a wavelength of 2.1 μm or longer and generates a photoelectron. The buffer layer is disposed between the light-absorbing layer and substrate, and their interfaces are lattice-matched, so that a favorable interface state is achieved, whereby stable light absorption is effected. If a bias voltage is applied between the first and second electrodes, then an electric field is generated within the photocathode, whereas the generated photoelectron is accelerated by this electric field, so as to be released into vacuum by way of the electron-emitting layer. The electron-emitting layer and light-absorbing layer are also lattice-matched at their interface, which is maintained in a favorable state, whereby electrons smoothly reach the surface of light-absorbing layer. The electrons having reached the surface are rapidly emitted into vacuum by the active layer.

Preferably, the As composition ratio x2 of the buffer layer changes stepwise or continuously from the substrate side to the light-absorbing layer side. As a consequence, lattice mismatching is alleviated between the buffer layer and the substrate and light-absorbing layer.

Alternatively, the buffer layer may comprise a superlattice structure formed by stacking a plurality of thin films having As composition ratios x2 different from each other. The lattice mismatching between the buffer layer and the substrate and light-absorbing layer is alleviated in this case as well.

The electron tube of the present invention is characterized in that it is an electron tube constituted by encapsulating any of the above-mentioned photocathodes and an anode into a vacuum envelope.

The term "electron tube" used herein is an apparatus for detecting weak light by use of a photocathode, which encompasses not only photomultiplier tube (photo-tube), but also various kinds of apparatus such as streak tube (streak camera) and image tube. Utilizing the photocathode of the present invention provides an electron tube which favorably detects light in the infrared region.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Figure 1:
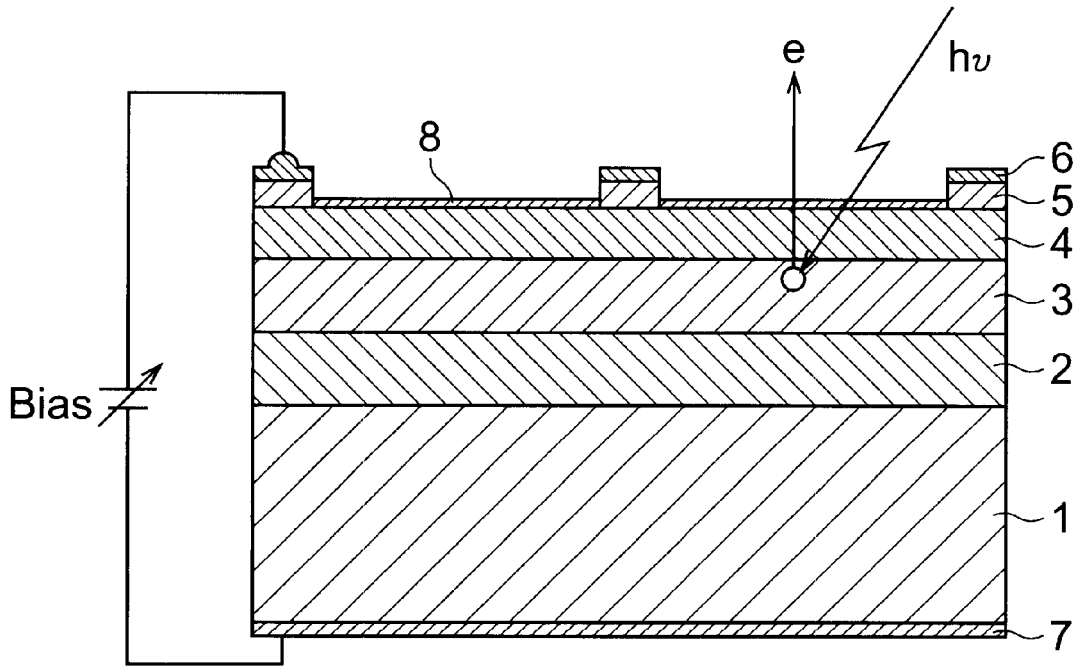
FIG. 1 is a schematic sectional view of the photocathode in accordance with the present embodiment.

In the following, preferred embodiments of the present invention will be explained with reference to the accompanying drawings. Here, for easier understanding of the explanation, constituents identical to each other will be referred to with reference numerals identical to each other among the drawings whenever possible without repeating their overlapping descriptions.

FIG. 1 is a schematic sectional view showing the configuration of a first embodiment of the photocathode in accordance with the present invention. As shown in FIG. 1, this embodiment comprises a buffer layer 2, a light-absorbing layer 3, and an electron-emitting layer 4 which are stacked on a substrate 1; a contact layer 5 formed on the surface of electron-emitting layer 4 with a predetermined pattern so as to partly expose the electron-emitting layer 4; a first ohmic electrode 6 formed on the contact layer 5; a second ohmic electrode 7 formed on the surface of substrate 1 opposite from its surface formed with the buffer layer 2; and an active layer formed on the exposed surface of electron-emitting layer 4 not formed with the contact layer 5.

Figures 2A, 2B:
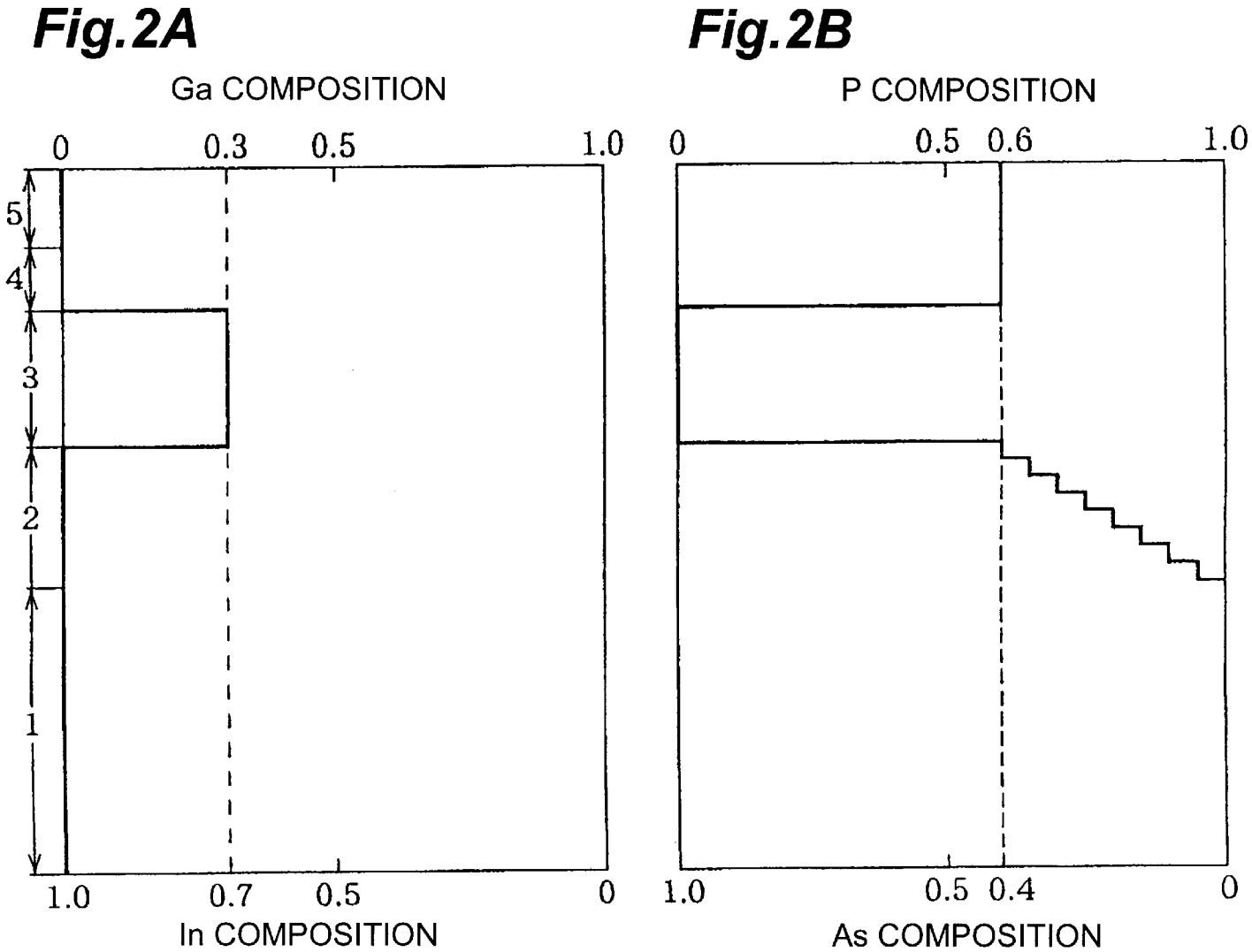
FIGS. 2A and 2B are graphs showing an example of compositions of individual layers in the photocathode in accordance with FIG. 1.
Figure 3:
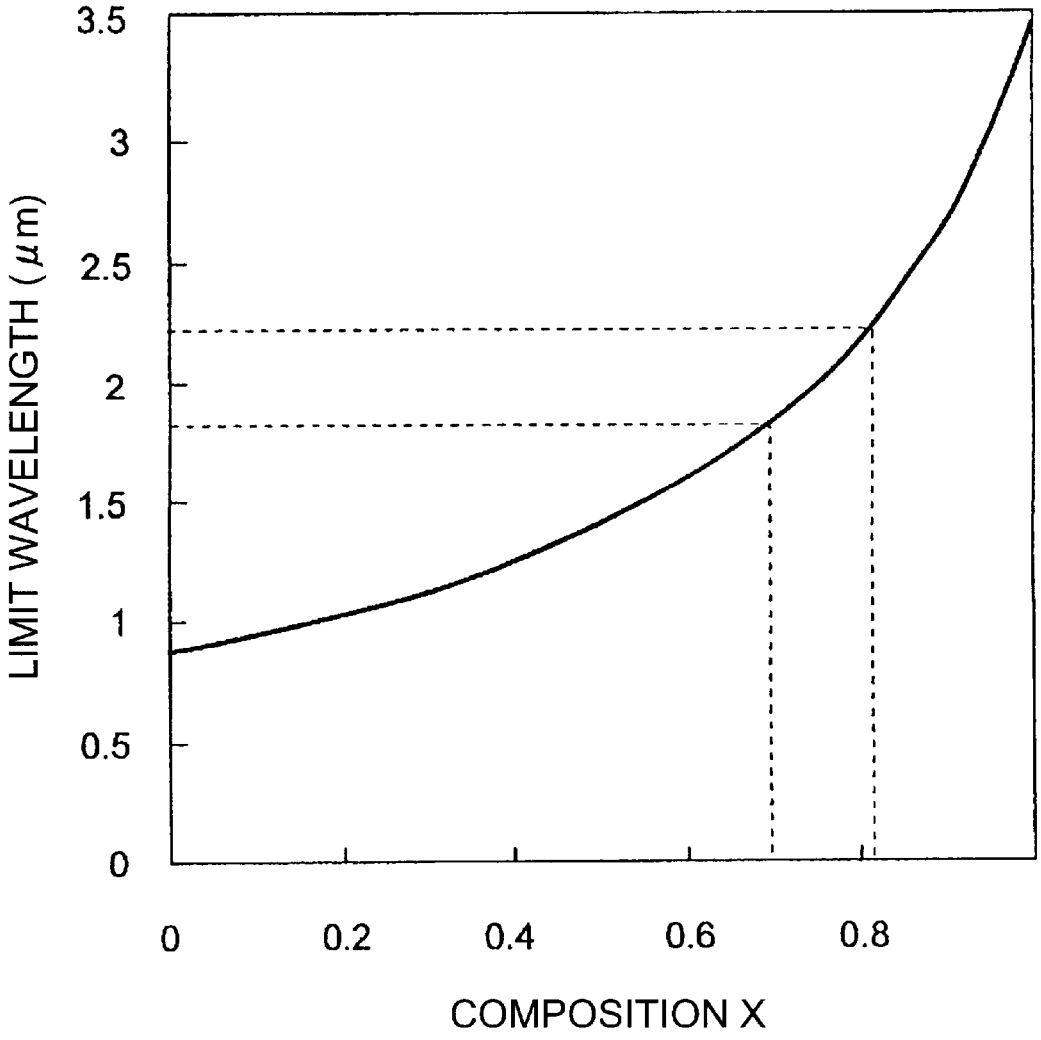
FIG. 3 is a graph showing the relationship between the composition ratio x1 of $In_{x1}Ga_{1-x1}As$ constituting the light-absorbing layer of the photocathode in accordance with FIG. 1 and detection limit wavelength.

FIGS. 2A and 2B show the composition distributions of this photocathode in the stacking direction. As shown in FIGS. 2A and 2B, the substrate 1 is made of InP of $p^+$ type (having a carrier concentration of $5\times10^{18}$ $cm^{-3}$), whereas the buffer layer 2 is made of $InAs_xP_{1-x}$ of p− type (having a carrier concentration of $1\times10^{17}$ $cm^{-3}$) whose composition ratio varies stepwise in the stacking direction. The As composition ratio x of the buffer layer 2 changes in nine steps in increments of x=0.05 from x=0 on the substrate 1 side to x=0.4 on the light-absorbing layer 3 side. The light-absorbing layer 3 is made of $In_{0.7}Ga_{0.3}As$ of p− type (having a carrier concentration of $1\times10^{16}$ $cm^{-3}$). FIG. 3 is a graph showing the relationship between the detection limit wavelength and In composition ratio x when an $In_xGa_{1-x}As$ type material is used for the light-absorbing layer 3. It can be seen from this graph that at least wavelengths up to 1.8 μm are detectable in this light-absorbing layer 3. The electron-emitting layer 4 is made of $InAs_{0.4}P_{0.6}$ of p− type (having a carrier concentration of $1\times10^{16}$ $cm^{-3}$), whereas the contact layer 5 is made of $InAs_{0.4}P_{0.6}$ of n+ type (having a carrier concentration of $3\times10^{18}$ $cm^{-3}$). The active layer 8 is made of CsO.

Manufacturing steps of this embodiment will be explained with reference to FIGS. 3, 4A to 4I, and 5. Here, FIG. 4 is schematic sectional views of this embodiment showing manufacturing steps thereof, whereas FIG. 5 is a graph showing the relationship between composition ratio and lattice constant in InAsP and InGaAs type crystals.

Figure 4A:
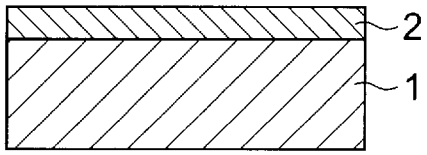
FIGS. 4A, 4B, 4C, 4D, 4E, 4F, 4G, 4H and 4I are schematic sectional views showing respective steps of making the photocathode in accordance with FIG. 1.
Figure 5:
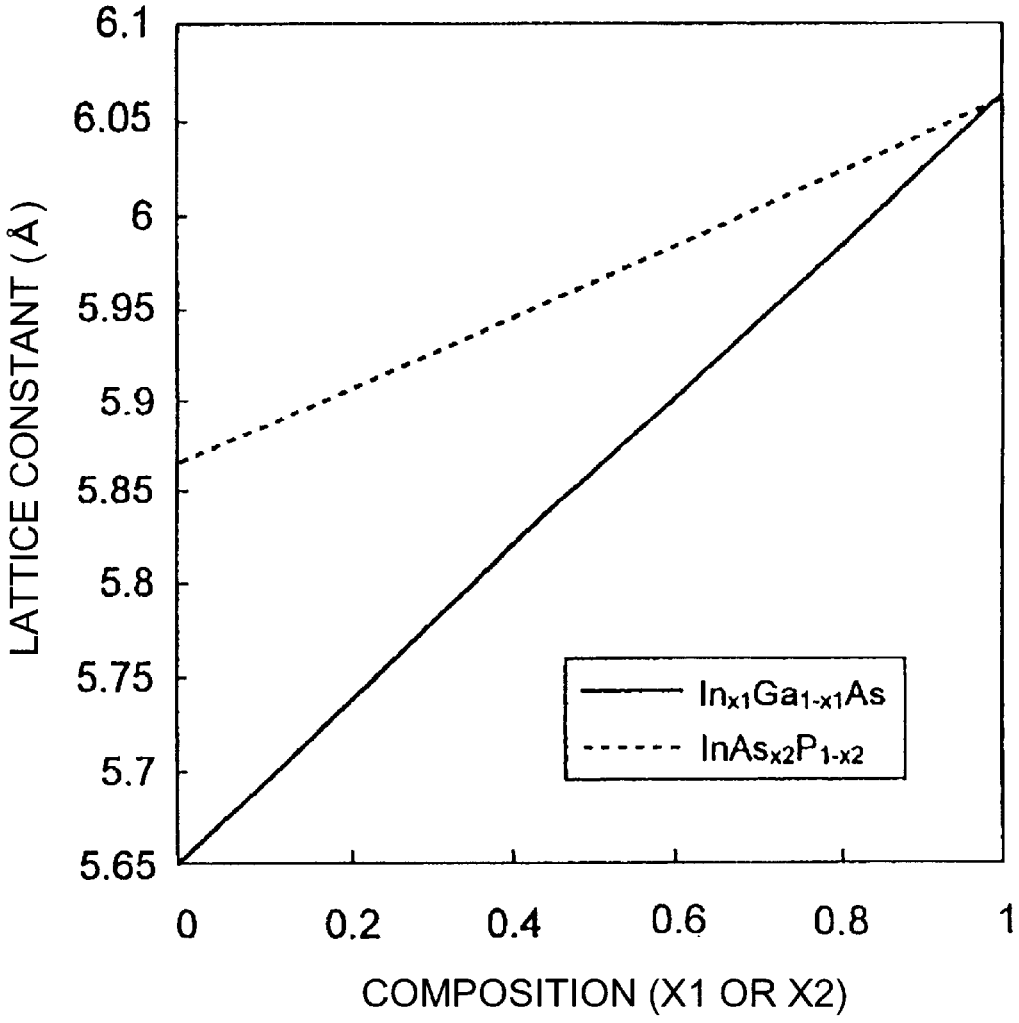
FIG. 5 is a graph showing changes in lattice constants due to changes in composition ratios x1, x2 of $In_{x1}Ga_{1-x1}As$ and $InAs_{x2}P_{1-x2}$.

First, as shown in FIG. 4A, the buffer layer 2 is epitaxially grown on the substrate 1 by metal organic vapor phase growth method. At this time, if nine layers whose As composition ratio x is varied in nine steps from 0 to 0.4 in increments of 0.05 are successively grown, then it is possible to yield a so-called step-graded structure in which the As composition ratio x changes stepwise in the stacking direction as shown in FIG. 2B.

Figure 4B:
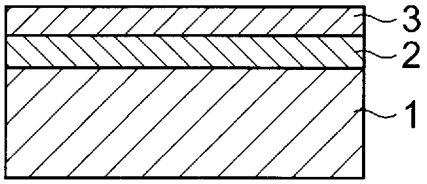

Then, as shown in FIG. 4B, the light-absorbing layer 3 having a film thickness of about 3 μm is epitaxially grown on the buffer layer 2. The topmost surface of the buffer layer 2 has a composition of $InAs_{0.4}P_{0.6}$ and a lattice constant of 5.930 angstroms which is identical to that of $In_{0.7}Ga_{0.3}As$ constituting the light-absorbing layer 3 as shown in FIG. 5, whereby a favorable interface with no lattice mismatching and less defects is formed. As a consequence, the light-absorbing layer 3 can be formed with a high quality.

Figure 4C:
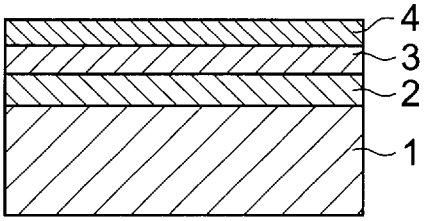

Subsequently, as shown in FIG. 4C, the electron-emitting layer 4 having a film thickness of about 0.5 $\mu$m is epitaxially grown on the light-absorbing layer 3. Since $InAs_{0.4}P_{0.6}$ constituting the electron-emitting layer 4 and $In_{0.7}Ga_{0.3}As$ constituting the light-absorbing layer 3 have the same lattice constant as mentioned above, a favorable interface with no lattice mismatching and less defects is formed here as well.

Figure 4D:
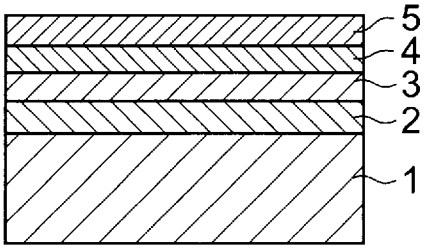

Further, as shown in FIG. 4D, the contact layer 5 having a thickness of about 0.2 $\mu$m is epitaxially grown on the electron-emitting layer 4. Since the electron-emitting layer 4 and the contact layer 5 are made of the same base material, a favorable p/n junction is formed without lattice mismatching.

Figure 4E:
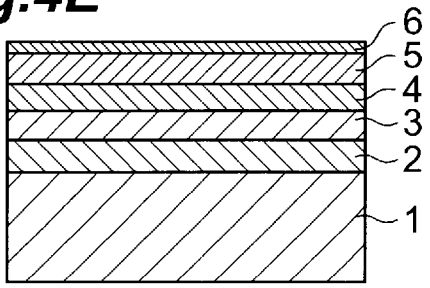

Subsequently, as shown in FIG. 4E, Ti is deposited on the contact layer 5 by about 0.1 $\mu$m, so as to form the ohmic electrode 6.

Figure 4F:
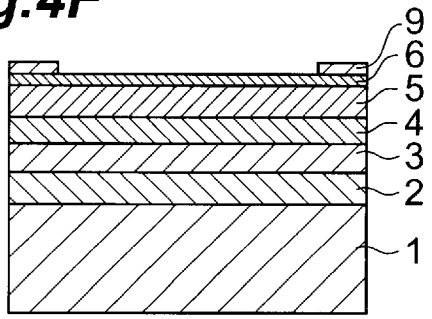

Thereafter, as shown in FIG. 4F, a photoresist 9 is applied onto the ohmic electrode 6, and a mask having a predetermined pattern is used so as to process the photoresist 9 by photolithography in conformity to the pattern of mask. Here, the processing is carried out in the form of rectangular meshes each having a size of 5×250 $\mu$m with a line width of 2 $\mu$m.

Figure 4G:
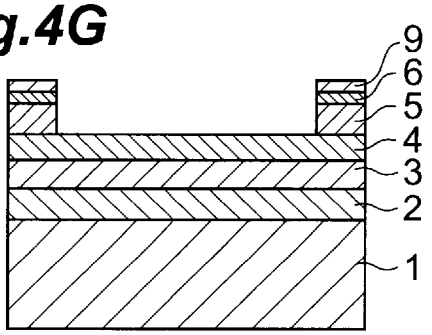

Then, as shown in FIG. 4G, reactive etching is effected from the surface formed with the photoresist 9, so as to eliminate the ohmic electrode 6 and the contact layer 5 thereunder in conformity to the exposed pattern from the exposed surface. Since the etching of these layers can accurately be controlled on the basis of etching time alone, etching control can be effected easily and accurately. After the exposed part of contact layer 5 is eliminated, wet etching is used for eliminating the surface of electron-emitting layer 4 by about 50 nm in order to remove the damaged layer caused by the etching of exposed surface in the electron-emitting layer 4.

Figure 4H:
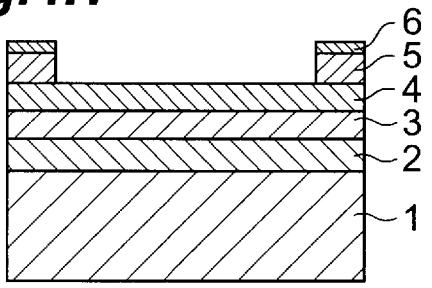
Figure 4I:
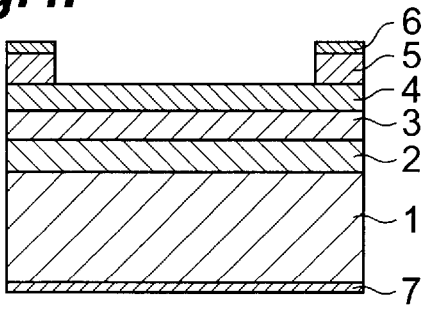

Thereafter, as shown in FIG. 4H, the photoresist 9 is eliminated, AuGe/Ni/Au is deposited over the whole rear surface of substrate 1 as shown in FIG. 4I, so as to form the ohmic electrode 7, and then the active layer 8 is applied to the exposed surface of electron-emitting layer, whereby the photocathode shown in FIG. 1 is completed.

Figure 6A:
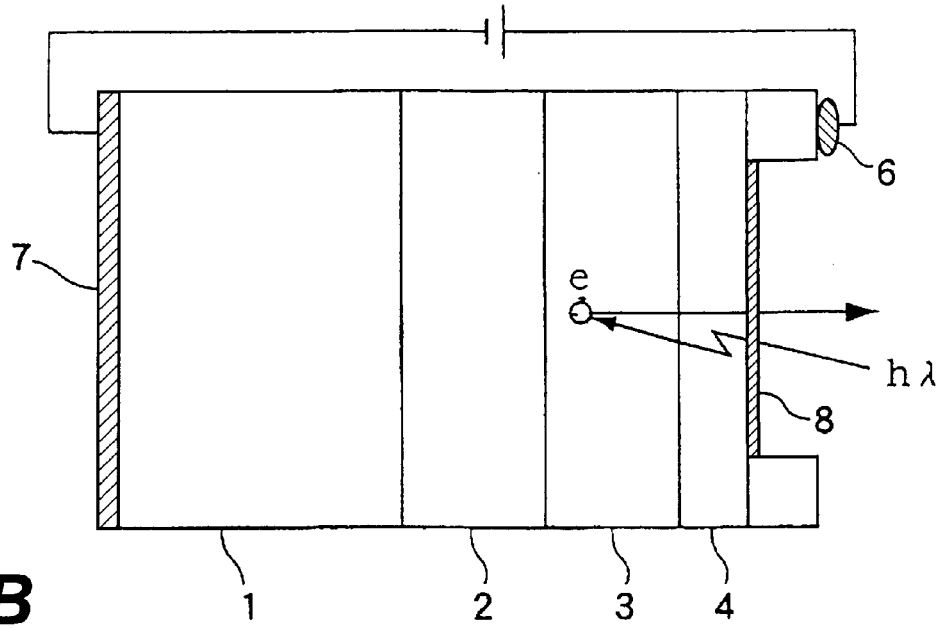
FIG. 6A is a cross-sectional view of the photocathode and FIG. 6B is an energy band chart showing energy levels in the photocahode shown in FIG. 6.
Figure 6B:
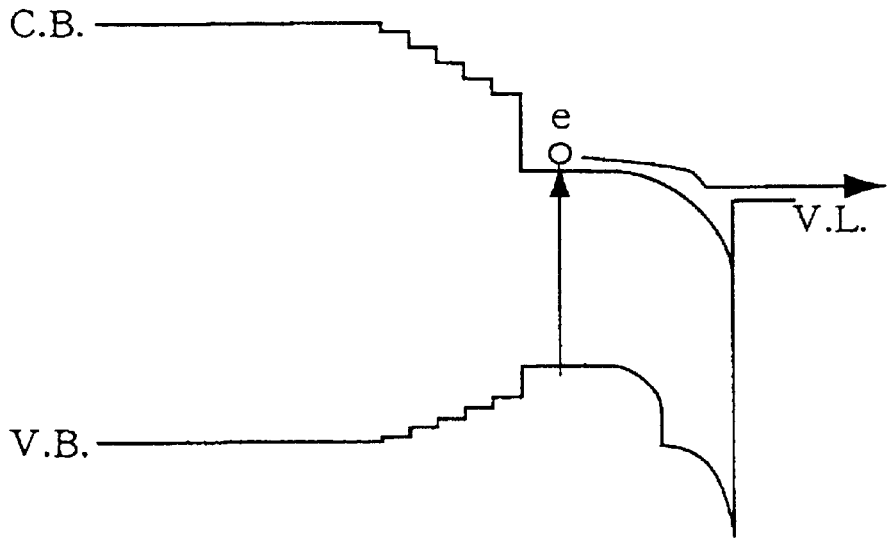

Operations of the photocathode in accordance with this embodiment will now be explained with reference to FIGS. 6A and 6B. FIG. 6A is a cross-sectional view of the photocathode in the present embodiment, and FIG. 6B is a band chart showing the energy state within the photocathode. Here, V.B, C.B, and V.L. indicate the energy levels at the top of valence band, at the bottom of conduction band, and in vacuum, respectively.

If a predetermined bias voltage is applied between the ohmic electrodes 6, 7, then a depletion layer is formed between the contact layer 5 and electron-emitting layer 6. At this time, since the respective carrier concentrations in the contact layer 5 and electron-emitting layer 6 are set higher and lower, the depletion layer is substantially extended toward the electron-emitting layer 6, so as to reach the light-absorbing layer 3. Namely, an internal electric field is formed in the electron-emitting layer 6 and light-absorbing layer 3.

If light to be detected hν is made incident on the surface, then, since the active layer 8 and electron-emitting layer 6 are transparent to the light to be detected hν, it passes through these layers, so as to reach and be absorbed by the light-absorbing layer 3, thereby generating an electron/hole pair, by which a photoelectron e is excited from V.B to C.B. Thus excited photoelectron e is accelerated rightward in the drawing by the above-mentioned internal electric field, i.e., toward the surface, so as to pass though the electron-emitting layer 4 and active layer 8, thereby being emitted into vacuum. Here, since the light-absorbing layer 3 and electron-emitting layer 4 lattice-match at their interface, the possibility of photoelectrons being recombined at this interface is very low, whereby most of photoelectrons reach the surface of electron-emitting layer 4 as they are. Also, since the active layer 8 acts to lower work function, the photoelectrons having reached the surface of electron-emitting layer 4 easily pass through the active layer 8, so as to be emitted into vacuum.

In order to verify the detection performance of the photocathode in accordance with the present invention in a long wavelength region, the inventor of the present application compared it with conventional products. Results of the comparison will be explained in the following.

Compared were the above-mentioned first embodiment of the present invention (hereinafter referred to as Example 1), Example 2 made capable of detection up to a longer wavelength, and the respective modes disclosed in literatures 2 and 4 (hereinafter referred to as Conventional Examples 1 and 2, respectively).

Example 2 has a basic configuration identical to that of the first embodiment shown in FIG. 1, whereas the light-absorbing layer 3 is constituted by $In_{0.82}Ga_{0.18}As$ so as to be capable of detection up to a longer wavelength. In order to lattice-match the light-absorbing layer 3 at the interface, the topmost surface of buffer layer 2 has a composition of $InAs_{0.6}P_{0.4}$. Consequently, both have the same lattice constant of 5.990 angstroms as shown in FIG. 5. Similarly, the electron-emitting layer 4 and contact layer have a composition of $InAs_{0.6}P_{0.4}$, so as to yield the same lattice constant, thereby achieving lattice matching.

Figure 7:
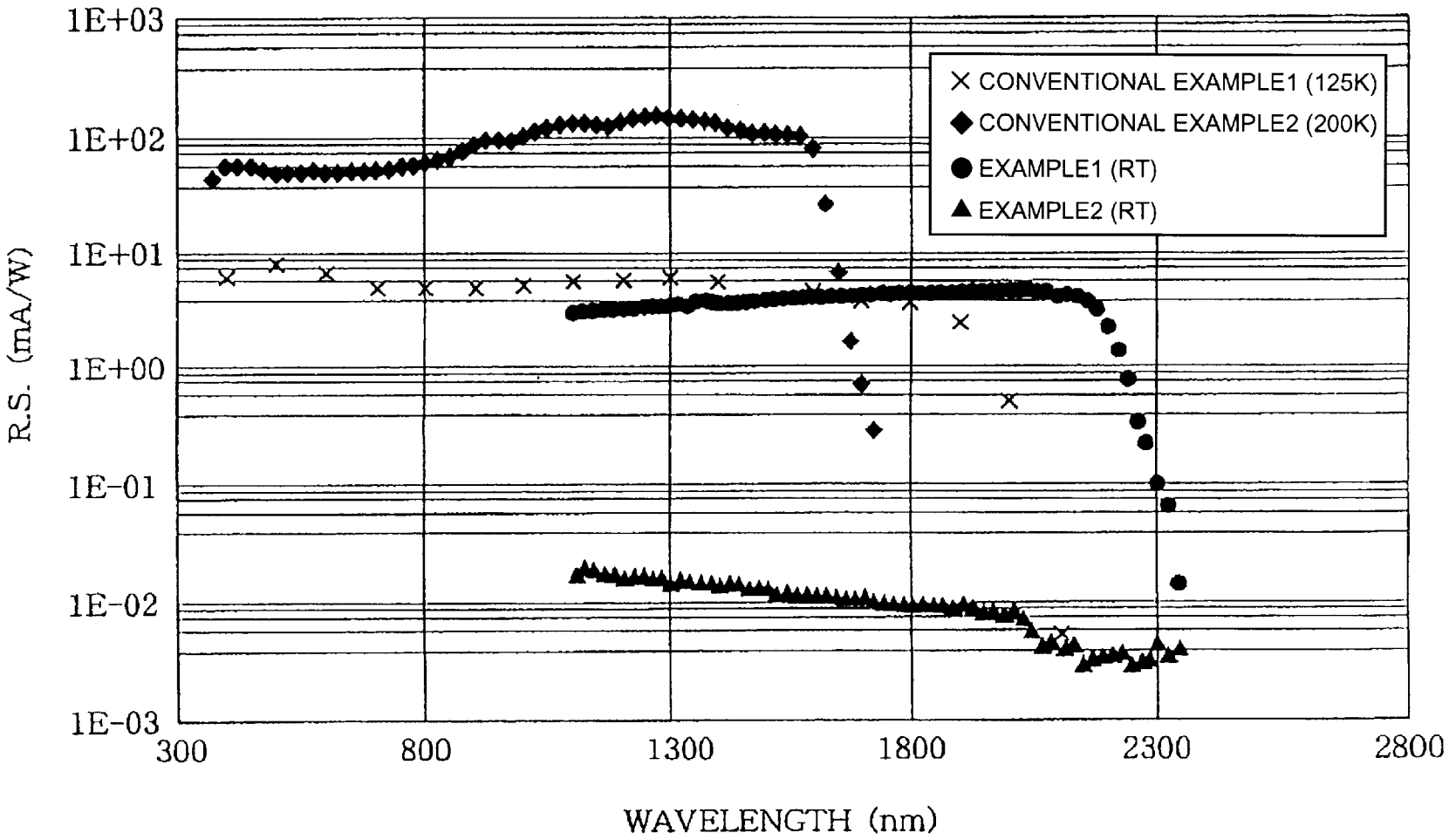
FIG. 7 is a chart comparing spectral sensitivity characteristics of the present embodiment and conventional photocathodes in terms of radiation sensitivity.
Figure 8:
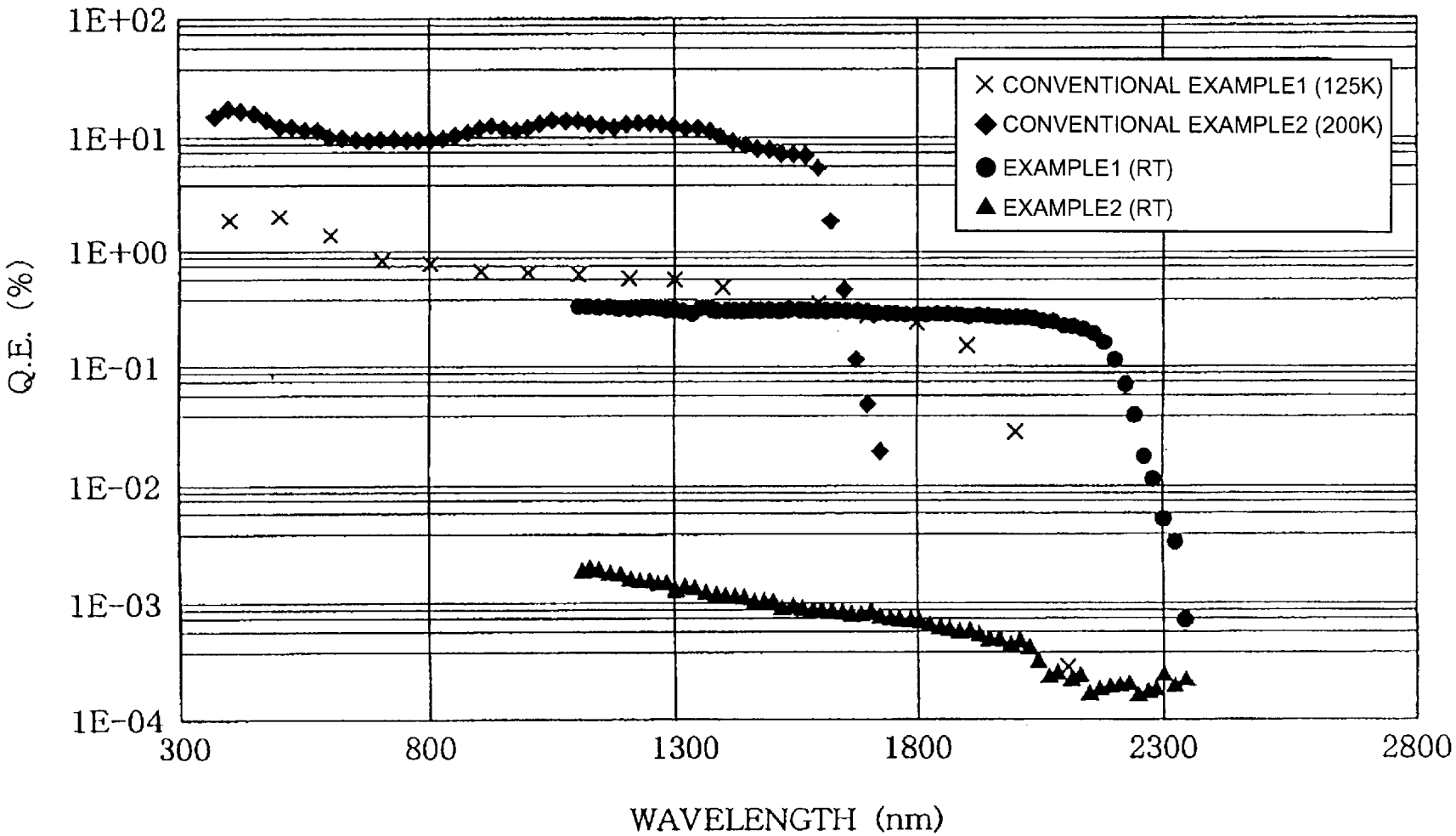
FIG. 8 is a chart comparing spectral sensitivity characteristics of the present embodiment and conventional photocathodes in terms of quantum efficiency.

FIGS. 7 and 8 are graphs comparing spectral sensitivity characteristics of Examples 1 and 2 and Conventional Examples 1 and 2, whose ordinates indicate radiation sensitivity and quantum efficiency, respectively.

As is clear from FIGS. 7 and 8, though both sensitivity and quantum efficiency are high in Conventional Example 2, they are values obtained when cooled to 200 K, and the sensitivity drastically lowers at a wavelength of 1.5 $\mu$m or longer. Also, though cooled to 125 K, the quantum efficiency of Conventional Example 1 is not on a par with that in Conventional Example 2, and the sensitivity also lowers at a wavelength of 1.8 $\mu$m or longer. Though photoelectron emission is seen even at a wavelength of 2.1 $\mu$m, its sensitivity is 1/10 or less of that in a region with a wavelength shorter than 1.8$\mu$m. By contrast, Example 1 of the present invention keeps a sensitivity on a par with that of Conventional Example 1 up to a wavelength of 2.2 $\mu$m. Also, this value is obtained at room temperature, whereby it is highly practical in that no cooling is necessary unlike Conventional Examples 1 and 2, which enables a wider range of application. In Example 2, on the other hand, though both sensitivity and quantum efficiency are lower than those in Example 1, photoelectron emission is observed even at a wavelength of 2.3 $\mu$m. This wavelength is the longest as the wavelength at which photoelectron emission has been observed in photocathodes. Thus, it has been verified that the present invention can provide a photocathode having a favorable sensitivity in the infrared wavelength region even at room temperature and yielding a high photoelectric conversion efficiency.

As mentioned above, the light-absorbing layer 3 can adjust its absorbing light wavelength region by regulating the In composition ratio x1 of $In_{x1}Ga_{1-x1}As$ constituting the layer. For yielding a sensitivity in an infrared region having a wavelength of 1.7 $\mu$m or longer, it is preferred that x1 be greater than 0.53 as can be seen from FIG. 3. If the In composition ratio x1 of light-absorbing layer 3 is determined, then the As composition ratio x2 of the topmost part of $InAs_{x2}P_{1-x2}$ constituting the buffer layer 2 and the As composition ratio x3 of $InAs_{x3}P_{1-x3}$ constituting the electron-emitting layer 4 and contact layer 5 are automatically obtained from the condition under which their lattice constant coincides with that of the light-absorbing layer 3, i.e., the condition shown in FIG. 5.

Figure 9B:
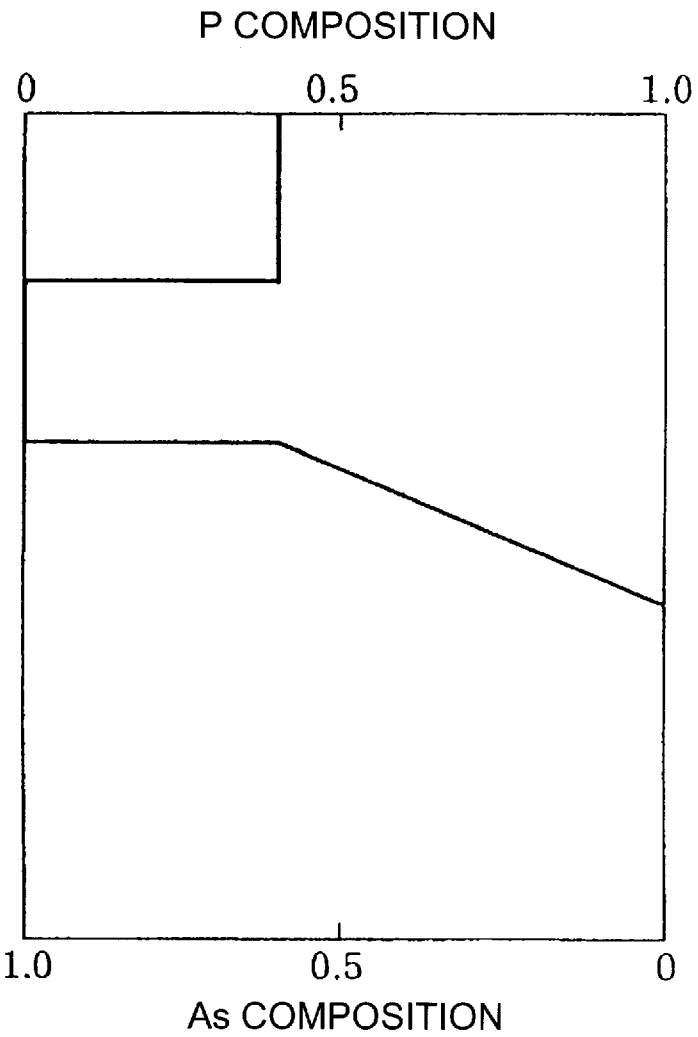
FIGS. 9A and 9B are graphs showing another example of compositions of individual layers in the photocathode in accordance with the present embodiment.
Figure 9A:
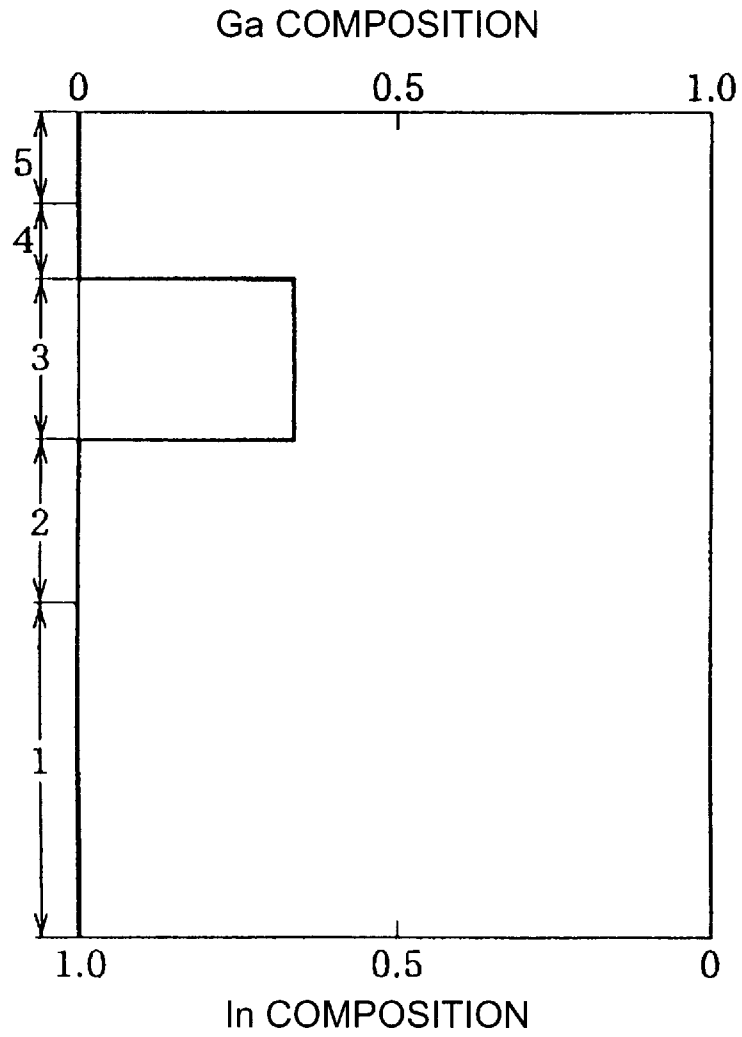
Figure 10B:
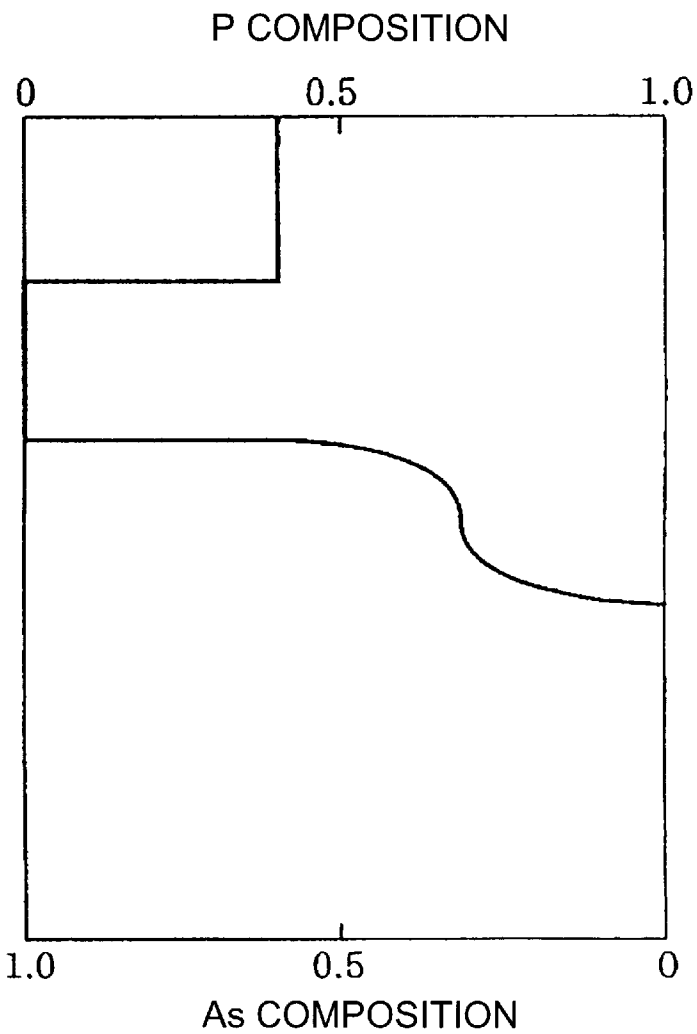
FIGS. 10A and 10B are graphs showing still another example of compositions of individual layers in the photocathode in accordance with the present embodiment.
Figure 10A:
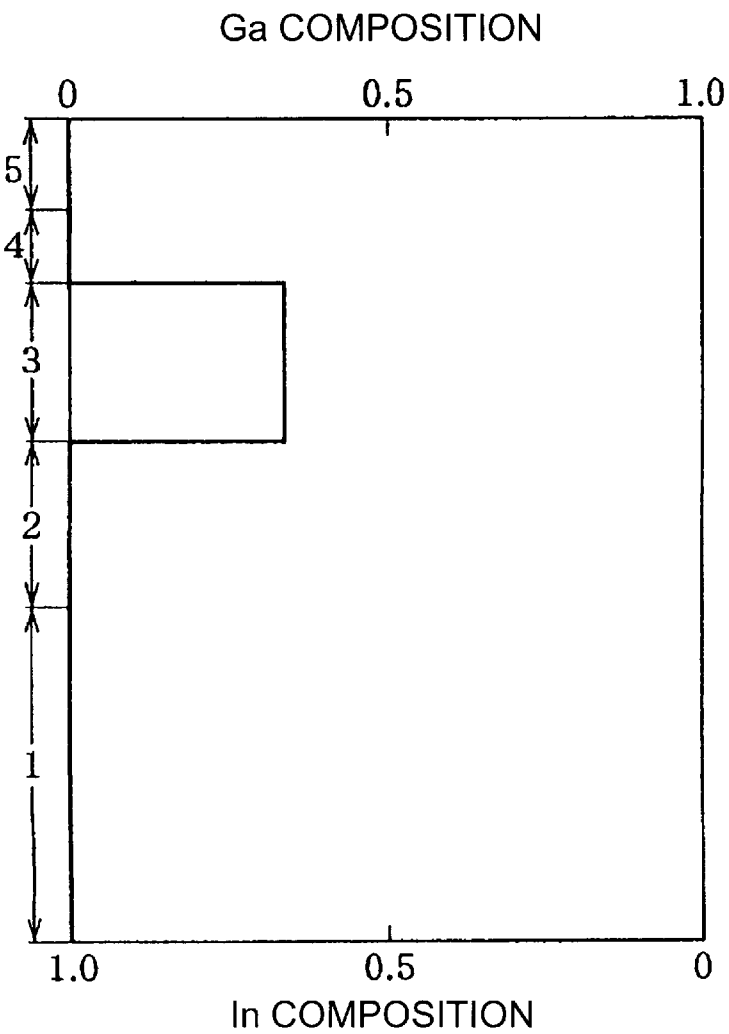
Figure 11B:
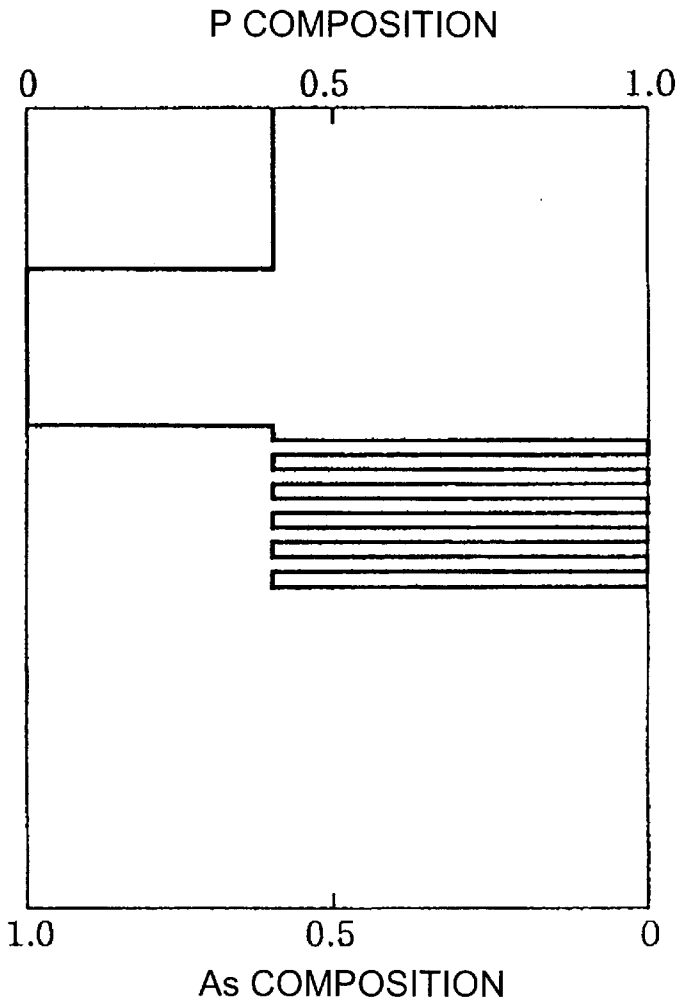
FIGS. 11A and 11B are graphs showing still another example of compositions of individual layers in the photocathode in accordance with the present embodiment.
Figure 11A:
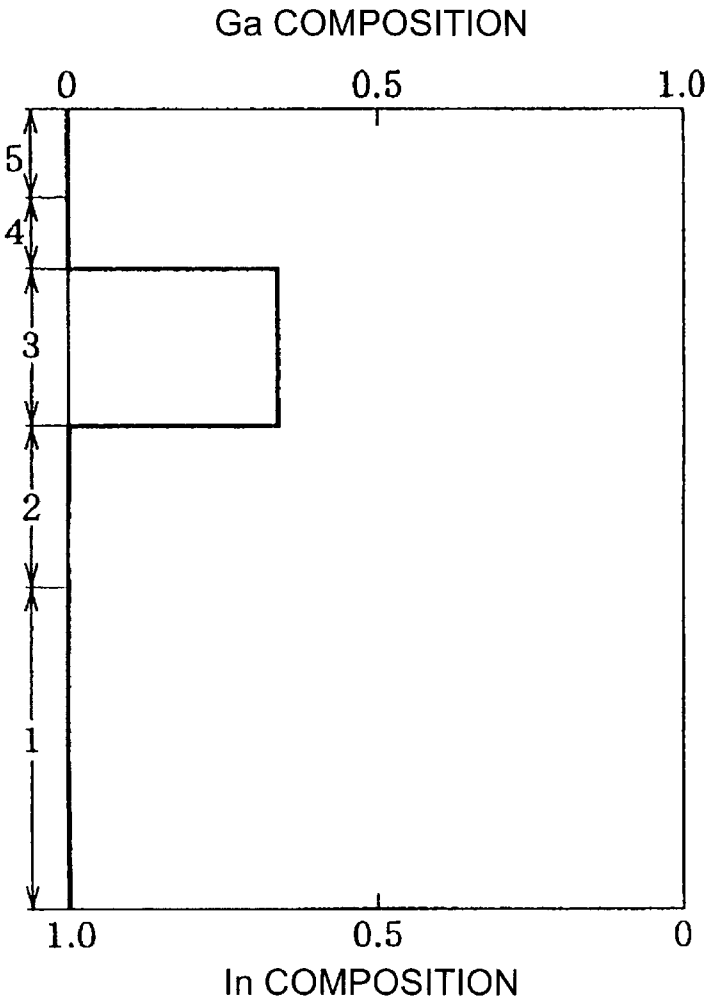

Though an example using a step-graded structure is explained concerning the buffer layer 3, the present invention is not limited thereto, and can employ a graded structure in which the As composition ratio x3 linearly changes from the substrate 1 side to the light-absorbing layer 3 side as shown in FIGS. 9A and 9B, and a structure in which the As composition ratio x3 continuously changes from the substrate 1 side to the light-absorbing layer 3 side as shown in FIGS. 10A and 10B. Further employable is a superlattice structure in which thin layers of InP identical to the substrate 1 and $In_{x1}Ga_{1-x1}As$ identical to the light-absorbing layer 3 are alternately overlaid as shown in FIGS. 11A and 11B. In each of these cases, the buffer layer 2 lattice-matches the substrate 1 and light-absorbing layer 3, so that the light-absorbing layer 3 has a favorable interface, whereby the light-absorbing layer 3 having a favorable quality can be made.

The film thickness and carrier concentration of each layer explained in the first embodiment is only an example thereof, and various film thickness and carrier concentration values can be set. If the carrier concentration of light-absorbing layer 3 or electron-emitting layer 4 is made higher, however, then the depletion layer may not extend from the surface of electron-emitting layer 4 to the inside of light-absorbing layer 3 upon application of bias voltage, which is unfavorable in that the sensitivity decreases. If the film thickness of electron-emitting layer 4 is too large, on the other hand, then it is necessary to enhance the bias voltage to be applied for elongating the above-mentioned depletion layer to the inside of the light-absorbing layer 3, which is also unfavorable in that dark current increases thereby.

Without being restricted to Ti, various kinds of metal electrodes can be used as the ohmic electrode 6. However, Ti is preferably used since controllability of etching process improves thereby.

The active layer 8 may be any material as long as it lowers the work function of the exposed electron-emitting layer surface, whereby alkali metals or their oxides or fluorides can be utilized therefor.

Usable as the exposed pattern of electron-emitting layer 4 are not only the above-mentioned rectangular mesh form, but also various kinds of forms such as a spiral form provided with a spiral contact layer 5 extending from the center, a tree form in which the contact layer 5 is branched, and a form in which square ohmic electrodes having a common center are connected together.

Though the above-mentioned explanations relate to reflection type photocathodes in which the light-entering surface and photoelectron-emitting surface coincide with each other, the present invention is also applicable to transmission type photocathodes which emit photoelectrons from the surface opposite from the light-entering surface. In this case, the second ohmic electrode 7 is formed into a thin film or like a grid or rim, such that light can enter the light-absorbing layer 3 from the substrate 1 side.

Though the above-mentioned explanations of manufacturing steps relate to the case where metal organic vapor phase growth method is employed, the photocathode of the present invention can employ not only this method, but also other vapor phase growth methods such as hydride vapor phase growth method, halide vapor phase growth method, and molecular beam epitaxy method.

Figure 12:
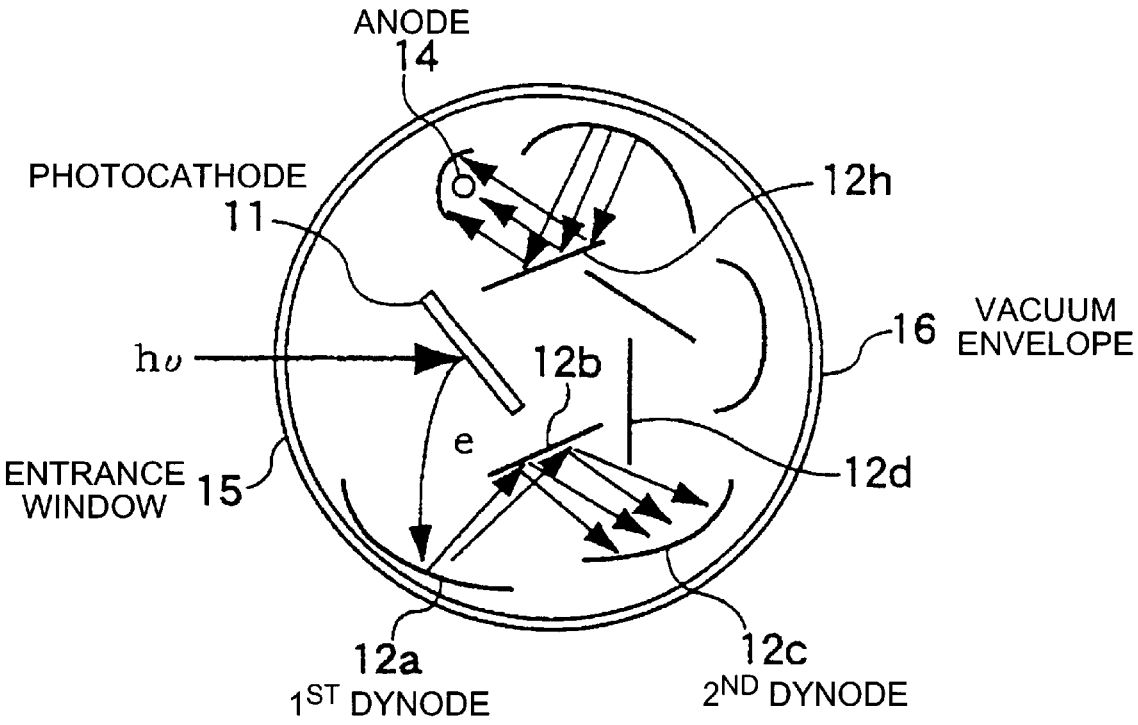
FIG. 12 is a sectional view showing a side-on type photomultiplier tube utilizing the photocathode of the present embodiment.

The photocathode of the present invention is applicable to the photocathode of a side-on type photomultiplier tube such as the one shown in FIG. 12. Namely, not only the photocathode 11 of the present invention, but also a plurality of dynodes 12*a* to 12*h* and an anode 14 are encapsulated within a vacuum envelope 16 of this photomultiplier tube.

Due to the incident light hv having entered from an entrance window 15 of the vacuum envelope 16, a photoelectron e is generated within the photocathode 11 as mentioned above and is emitted into the vacuum envelope 16. Due to thus emitted photoelectron e, secondary electrons are generated in each of the group of dynodes 12*a* to 12*h* and are sent to its subsequent dynode, so as to be multiplied. As a result, each photoelectron e eventually multiplies into about $10^6$ pieces of electrons, which are made incident on the anode 14 and then are taken out as detected electric signals. For use in a head-on type photomultiplier tube, the above-mentioned transmission type photocathode is employed.

Various kinds of electron tubes for detecting light in the infrared region, such as streak camera and image intensifier, can be provided if the photocathode of the present invention is employed as their photocathode.

As explained in the foregoing, between a substrate and a light-absorbing layer, a buffer layer lattice-matching both of them is disposed in the present invention, whereby it is possible to form a light-absorbing layer which can favorably emit photoelectrons even in the infrared region. Further, since the electron-emitting layer and light-absorbing layer lattice-match each other, generated photoelectrons reach the surface of electron-emitting layer without being recombined at the interface of these layers. Also, since an active layer which lowers work function is disposed on the exposed surface of electron-emitting layer, the electrons having reached the electron-emitting layer surface are easily emitted into vacuum. Further,a depletion layer is extended from the electron-emitting layer surface to the light-absorbing layer, whereby the photoelectrons are sent to the electron-emitting layer surface due to the formed internal electric field. Thus obtained is the photocathode having a favorable sensitivity in an infrared region even at room temperature.

If a structure in which the As composition ratio in the buffer layer is changed continuously or stepwise from the substrate side to the light-absorbing layer side or a superlattice structure is used, then a buffer layer lattice-matching both of the substrate and light-absorbing layer can easily be made.

Utilizing this photocathode provides various kinds of electron tubes detecting light in the infrared region.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photocathode for emitting a photoelectron in response to light in an infrared region incident thereon, said photocathode comprising:

a substrate comprising InP of a first conduction type;

a buffer layer, formed on said substrate, comprising $InAs_{x2}P_{1-x2}$, where 0<x2 <1, of the first conduction type, said buffer layer having a lattice constant matching a lattice constant of said substrate;

a light-absorbing layer, formed on said buffer layer, comprising $In_{x1}Ga_{1-x1}As$, where 1>x1>0.53, of the first conduction type, said light-absorbing layer having a lattice constant matching a lattice constant of said buffer layer;

an electron-emitting layer, formed on said light-absorbing layer, comprising $InAs_{x3}P_{1-x3}$, where 0<x3<1, of the first conduction type, said electron-emitting layer having a lattice constant matching a lattice constant of said light-absorbing layer;

a contact layer, formed on said electron-emitting layer with a predetermined pattern so as to expose said electron-emitting layer with a substantially uniform distribution, comprising $InAs_{x3}P_{1-x3}$ of a second conduction type;

an active layer, formed on the exposed surface of said electron-emitting layer, comprising an alkali metal or an oxide or fluoride thereof;

a first electrode formed on said contact layer; and a second electrode formed in said substrate.

2. A photocathode according to claim 1, wherein the As composition ratio x2 of said buffer layer changes stepwise or continuously from said substrate side to said light-absorbing layer side.

3. A photocathode according to claim 1, wherein said buffer layer comprises a superlattice layer formed by stacking a plurality of thin films having As composition ratios x2 different from each other.

4. An electron tube constituted by encapsulating the photocathode according to any of claims 1, 2 or 3 and an anode into a vacuum envelope.

* * * * *